United States Patent [19]

Ferrall

[11] Patent Number: 4,631,768

[45] Date of Patent: Dec. 30, 1986

[54] COMPOSITE BED MATTRESS

[75] Inventor: Peter J. Ferrall, Craigie, Australia

[73] Assignee: C. R. Diffen Transport Pty. Ltd., Australia

[21] Appl. No.: 681,646

[22] Filed: Dec. 14, 1984

[30] Foreign Application Priority Data

Feb. 29, 1984 [AU] Australia ..... PG3838

[51] Int. Cl.[4] ..... A47C 27/00; A47C 27/14

[52] U.S. Cl. ..... 5/464; 5/481

[58] Field of Search ..... 5/447, 464, 465, 481; 297/DIG. 1

[56] References Cited

U.S. PATENT DOCUMENTS

| | | | |
|---|---|---|---|
| 2,469,084 | 1/1945 | Schenker . | |
| 2,604,642 | 7/1952 | Marlo | 5/481 |
| 3,083,380 | 4/1963 | Adler | 5/464 |
| 3,451,071 | 6/1969 | Whiteley | 5/465 |
| 3,885,258 | 5/1975 | Regan . | |
| 4,053,957 | 10/1977 | Regan | 5/447 |
| 4,476,594 | 10/1984 | McLeod | 5/464 |

FOREIGN PATENT DOCUMENTS 511996 9/1978 Australia .

*Primary Examiner*—Gary L. Smith
*Assistant Examiner*—Michael F. Trettel
*Attorney, Agent, or Firm*—Kerkam, Stowell, Kondracki & Clarke

[57] ABSTRACT

The invention provides a composite bed mattress comprising a first, relatively firm foam layer and a second, relatively soft foam layer said first and second layers being disposed in face to face contiguous relationship to one another, wherein the first foam layer contains at least one recess adjacent the second foam layer and the second foam layer has a respective, relatively soft, foam projection which fits into each recess, and the region of the mattress containing the or each recess and projection corresponds, in use, with the hip region of a person laying on an upper surface of the mattress.

10 Claims, 3 Drawing Figures

COMPOSITE BED MATTRESS

The present invention relates to composite bed mattresses. In general, bed mattresses are conventionally arranged to provide uniform support throughout a substantially horizontal upper surface thereof. Such bed mattresses are thus best suited to support bodies of a substantially uniform shape and density. Human bodies lack such uniformity and are disadvantaged in the use of such a bed mattress. In particular, a human body tends to be weighted about its hip region. If a person has a relatively inefficient circulatory system, the weight bias in the hip region can cause the person discomfort through poor circulation and pressure points when lying on a conventional mattress. The present invention alleviates the aforesaid discomfort by providing a non uniform amount of support such that the area of the bed mattress corresponding to a person's hip region is softer than other areas of the bed mattress. Thus, the person's hip region can be disposed at a lower level than is usual when lying on a mattress.

Furthermore, the lowering of the person's hip region in relation to the remainder of the body, assists in keeping the spinal cord in a more natural alignment. This relieves stress otherwise induced in the person's back.

In accordance with one aspect of the present invention there is provided a composite bed mattress comprising a first, relatively firm foam layer and a second, relatively soft foam layer said first and second layers being disposed in face to face contiguous relationship to one another, wherein the first foam layer contains at least one recess adjacent the second foam layer and the second foam layer has a respective, relatively soft, foam projection which fits into each recess, and the region of the mattress containing the or each recess and projection corresponds, in use, with the hip region of a person laying on an upper surface of the mattress.

The present invention will now be described, by way of example, with reference to the accompanying drawings, in which.

Figure 1:
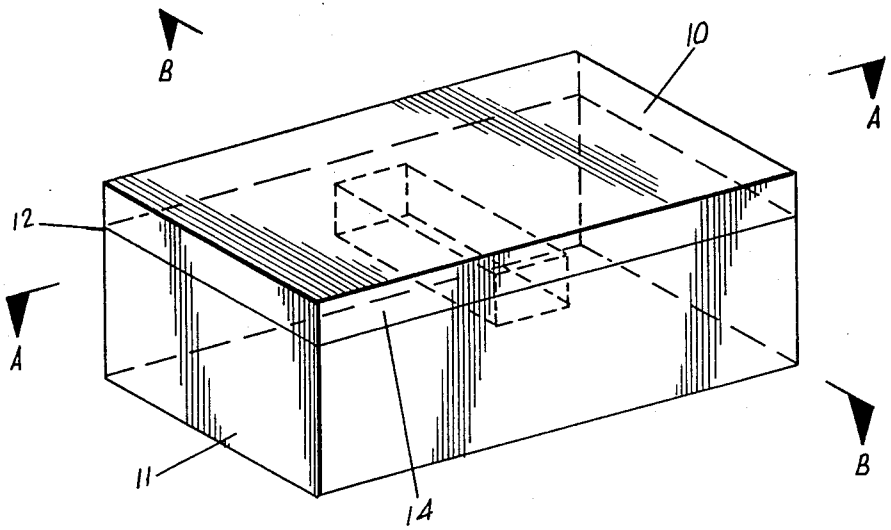
FIG. 1 is an upper perspective view of a composite bed mattress in accordance with the present invention.
Figure 2:
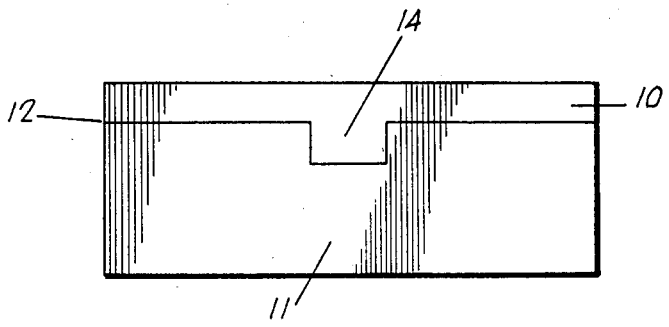
FIG. 2 is a longitudinal section along the line A—A of FIG. 1.
Figure 3:
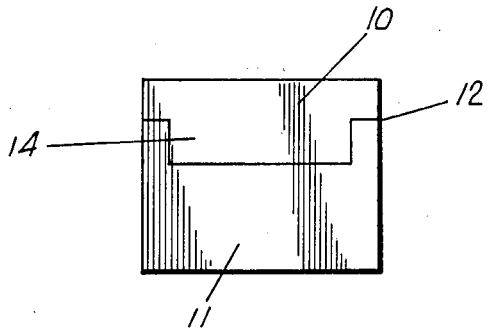
FIG. 3 is a lateral section along the line B—B of FIG. 1.

In the drawings there is shown a composite bed mattress comprising an upper resilient foam layer 10 and a lower resilient foam layer 11. The lower foam layer 11 is relatively firm while the upper foam layer 10 is relatively soft. Further the upper foam layer has a lower surface 12 with an integral projection 14 extending from it. The lower foam layer 11 contains a recess or hip well arranged to receive snugly the projection 14. The upper and lower foam layer 10 and 11 are mounted in face to face contiguous relationship and are laminated together by means of glue.

The projection 14 of the upper layer 10 extends into the recess of the lower layer 11 and may have a width in the range from 250 mm to 560 mm, preferably in the range from 320 mm to 370 mm for a standard single or double bed mattress and preferably in the range from 370 mm to 420 mm for a queen size bed mattress. Typically, a single bed mattress would have a single recess while a double or larger bed mattress would have two appropriately located recesses. Furthermore, the projection 14 may have a total depth, as measured from the upper surface of the upper layer 10, of from 25 mm to 130 mm, for example 70 mm.

To attain best results it is preferred that the proportions of the components of the bed mattress be maintained within certain limits.

For example, the ratio b/c between b (softness of lower resilient layer 16) to c (softness of upper resilient layer 10) is preferably in the range from 0.1 and 0.7.

Also, the ratio d/e between d (depth of upper resilient layer 10, adjacent the projection to e (depth of the projection 14 from lower surface 12 of said layer 10) is preferably between 0.2 and about 1.

The bed mattress of FIG. 1 is typically mounted upon a bed base, with said bed base mounted on a floor.

In use, the composite bed mattress is preferably oriented with its softer layer 10 uppermost and the projection 14 extending into the recess of the firmer layer 16, but it is realised that a reverse form of construction may also achieve similar results. In this case the lower layer 11 is softer, but still forms the projection 14, whilst the upper layer 10 is firmer. Furthermore, the width and depth of said projection 14 could be altered to give a similar amount of support. A person lays on the bed mattress with his head adjacent one end thereof and his feet adjacent the opposite end thereof. The person's hip is located above the projection 14 and, because the layer 10 and projection 14 are formed of relatively soft foam, the hip region tends to be lowered compared to its position on a conventional mattress giving uniform support. As discussed hereinabove, this can reduce circulatory problems and improve spine posture.

The recess or hip well is preferably located so that the composite bed mattress can be horizontally rotated through 180° to a new position and used in this position in which a user's head is resting on the opposite end of the bed mattress. Also, the recess or hip well could be contoured to have walls with a gradual slope rather than a steep drop. Modifications and variations such as would be apparent to a skilled addressee are deemed within the scope of the present invention. For example, the projection 14 need not be a rectangular shape, for example a triangular or circular shape could be used. Furthermore, the projection 14 could extend entirely across the width of the bed mattress.

I claim:

1. A composite bed mattress comprising first lower resilient foam layer and a second upper resilient foam layer, said first foam layer being relatively firm compared to said second foam layer, said first and second foam layers being disposed in face to face contiguous relationship to one another, said first and said second foam layers having abutting major substantially planar surfaces across the across extent of the surfaces, wherein said first foam layer contains a single recess in its planar surface adjacent the second foam layer, said second foam layer has a single foam projection which is relatively soft compared to said first foam layer and which fits into said recess, and the region of the mattress containing said recess and said projection corresponds with the hip region of a person laying on the mattress, so that the region of the mattress corresponding with the hip region of a person laying on the mattress is relatively soft compared to all other regions of the mattress.

2. A composite bed mattress according to claim 1, in which said projection of the said second foam layer is integrally formed with said second foam layer.

3. A composite bed mattress according to claim 1 in which said first and second layers are laminated together by means of glue.

4. A composite bed mattress according to claim 1, which is generally rectangular and has opposed ends and opposed sides, and in which said projection extends transversely across the mattress and has a width in a direction parallel to the sides in the range from 250 mm to 560 mm.

5. A composite bed mattress according to claim 4, in which said projection has a width in the range from 320 mm to 560 mm.

6. A composite bed mattress according to claim 1, which is generally rectangular and has opposed ends and opposed sides, and in which said recess and said corresponding projection extend transversely across the mattress for the entire distance between the opposed sides.

7. A composite bed mattress according to claim 1, in which said projection has a total depth, as measured from the upper surface of the second foam layer, of from 25 mm to 130 mm.

8. A composite bed mattress according to claim 1, in which the ratio of the softness of the first foam layer to that of the second foam layer is in the range from 0.1 to 0.7.

9. A composite bed mattress according to claim 1, in which ratio of the depth of the second foam layer adjacent said projection to that of said projection as measured from the upper surface of the second foam layer is in the range from 0.2 to 1.

10. A composite bed mattress according to claim 1, in which said recess is arranged so that the mattress can be horizontally rotated through 180° to a new position so that a user's head is resting on the opposite end of the mattress whilst said recess and corresponding projection still corresponds, in use, with the hip region of a person laying on the mattress.

* * * * *